US011565167B2

(12) United States Patent
Lanuti et al.

(10) Patent No.: US 11,565,167 B2
(45) Date of Patent: Jan. 31, 2023

(54) SYSTEM, METHOD, AND APPARATUS FOR MANAGING MINIATURE GOLF PLAYERS

(71) Applicant: Creative Works, Inc., Mooresville, IN (US)

(72) Inventors: Armando Lanuti, Carmel, IN (US); Mark McLaughlin, Greenwood, IN (US)

(73) Assignee: Creative Works, Inc., Mooresville, IN (US)

( * ) Notice: Subject to any disclaimer, the term of this patent is extended or adjusted under 35 U.S.C. 154(b) by 19 days.

(21) Appl. No.: 17/017,217

(22) Filed: Sep. 10, 2020

(65) Prior Publication Data

US 2021/0146223 A1 May 20, 2021

Related U.S. Application Data

(60) Provisional application No. 62/935,823, filed on Nov. 15, 2019.

(51) Int. Cl.

| | |
|---|---|
| ***A63B 71/06*** | (2006.01) |
| ***A63B 67/02*** | (2006.01) |
| ***A63B 24/00*** | (2006.01) |

(52) U.S. Cl.

CPC ..... *A63B 71/0669* (2013.01); *A63B 24/0021* (2013.01); *A63B 67/02* (2013.01); *A63B 71/0605* (2013.01); *A63B 2024/0025* (2013.01); *A63B 2024/0034* (2013.01); *A63B 2220/806* (2013.01); *A63B 2225/15* (2013.01); *A63B 2225/50* (2013.01)

(58) Field of Classification Search

CPC . A63B 71/0669; A63B 24/0021; A63B 67/02; A63B 71/0605; A63B 2024/0025; A63B 2024/0034; A63B 2220/806; A63B 2225/15; A63B 2225/50; A63B 2024/0053; A63B 2071/0694; A63B 2220/10; A63B 2220/808; A63B 2225/20

See application file for complete search history.

(56) References Cited

U.S. PATENT DOCUMENTS 6,974,391 B2 * 12/2005 Ainsworth ..... A63B 47/025 473/191
9,339,715 B2 * 5/2016 Luciano, Jr. ..... G06Q 30/0212
2016/0303443 A1 * 10/2016 Boggs ..... A63B 53/14

FOREIGN PATENT DOCUMENTS

EP 1246672 A2 * 10/2002 ..... A63B 24/0021
EP 1246672 B1 6/2005

OTHER PUBLICATIONS

Go Golf Brochure, Copyright 2013, World Golfing Systems.
https://www.impinj.com/library/customer-stories/topgolf-transforms-driving-ranges-with-rain-rfid TopGolf Transforms Golf Driving Ranges with RAIN RFID, Top Golf.

* cited by examiner

*Primary Examiner* — Jeffrey S Vanderveen
(74) *Attorney, Agent, or Firm* — Larson & Larson, P.A.; Frank Liebenow; Justin P. Miller

(57) ABSTRACT

A method and apparatus for automatically scoring a golf player includes detecting and recording the golf player at a golf tee pad by an identification reading device at the golf tee pad reading an identification device of a golf club that is used by the golf player. Movement of a golf ball after it is hit by the golf club is detected. A location of the golf ball when the golf ball stops is recorded and the golf player is credited with a stroke. Subsequently, each time movement of the golf ball is detected, the location of the golf ball is updated and the golf player is credited with another of the stroke.

16 Claims, 5 Drawing Sheets

SYSTEM, METHOD, AND APPARATUS FOR MANAGING MINIATURE GOLF PLAYERS

CROSS-REFERENCE TO RELATED APPLICATION

This application claims the benefit of U.S. provisional application No. 62/935,823 filed on Nov. 15, 2020, the disclosure of which is incorporated by reference.

FIELD

This invention relates to the field of golf and more particularly to a system for recognizing a player at a miniature golf tee.

BACKGROUND

The field of miniature golf is enjoyed by countless people, young and old, requiring some skill, but minimal physical exertion. Many miniature golf courses have unique features and/or targets during the progression from the tee pad to the hole, making the game more difficult and less predictable, and therefore, more enjoyable.

For long, scoring of strokes at miniature golf required the use of a pencil (usually a very short pencil) and a score card having a column for each player and a row for each hole. One player typically keeps score for all players by writing the number of strokes each player takes in moving that player's ball from the tee pad to the hole. Very little progress has been made in progressing to a more automated, electronic method of keeping score. At the most, applications have appeared for smartphones that lets the score keeper enter the scores; instead of writing them on the score card, they enter the scores into the application.

One method of automatically scoring is proposed in U.S. Pat. No. 5,582,550 to Foley. In this, a radio-frequency transmitter and a hit sensor are embedded into a golf ball. Each time the ball is hit, the sensor emits a radio signal indicating the identification of the ball that was hit. If a ball is hit three times, then three transmissions are received by a radio frequency reader near the golf hole (playing surface). Note that there are several issues with embedding such electronics into a golf ball. First, this will add to the cost of the golf ball, and as miniature golf course owners well know, many golf balls are lost every year. Second, the electronics inside the ball must be continuously powered, as there is no place for a switch on the outside surface of the golf ball. Hence, from the date of manufacture, the internal battery will constantly drain and have a very limited life. Therefore, embedding of an active electronic assembly into a golf ball has limited practicality.

Therefore, a way is needed to determine who is at the tee pad and, therefore, who is hitting the ball.

SUMMARY

In one embodiment, a miniature golf system is disclosed including a golf tee pad that includes an identification reading device. Each golf club has an identification device associated with the golf club that is readable by the identification reading device. A computer receives identification information from the identification reading device and associates the identification information with a golf player who is at the golf tee pad.

In another embodiment, a method of automatically scoring a golf player is disclosed including detecting and recording the golf player at a golf tee pad by an identification reading device at the golf tee pad reading an identification device of a golf club that is used by the golf player. Next, movement of a golf ball after it is hit by the golf club is detected and a location of the golf ball when the golf ball stops is recorded and the golf player is credited with a stroke. Subsequently, each time movement of the golf ball is detected, the location of the golf ball is updated and the golf player is credited with another of the stroke.

In another embodiment, program instructions tangibly embodied in a non-transitory storage medium that automatically score a golf player are disclosed. The at least one instruction includes computer readable instructions that receive from an identification reading device, a value of an identification device of a golf club that is used by the golf player at a golf tee pad. The computer readable instructions then receive data from a plurality of ball detectors indicating movement of a golf ball after it is hit by the golf club, thereby recording a location of the golf ball when the golf ball stops and crediting the golf player with a stroke. Subsequently, each time the computer readable instructions detect movement of the golf ball, the computer readable instructions update the location of the golf ball and credits the golf player with another of the stroke.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
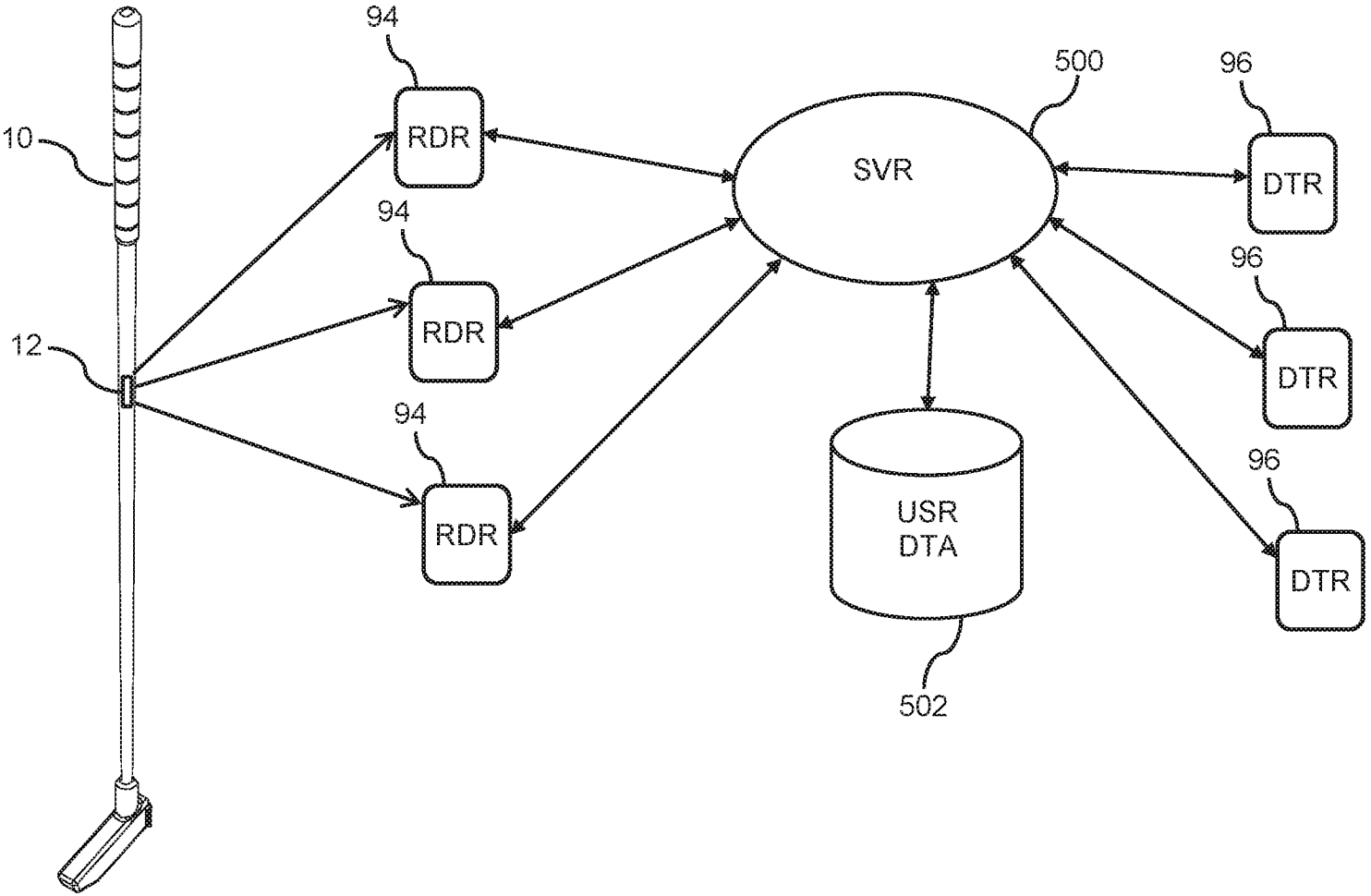
FIG. 1 illustrates a data connection diagram of a system for managing miniature golf players.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a data connection diagram of the system for managing miniature golf players is shown. In this example, one or more identification reading devices 94 are configured to read an identification device 12 on a golf club 10. The identification reading devices 94 are operationally connected to a server computer 500, either directly or indirectly, wired or wireless. The server 500 receives identification information from the identification reading devices 94 when the identification device 12 is presented at the identification reading devices 94. The server 500 determines which golf player is present at a given location of the golf hole 19 (see FIG. 5) from the identification information. In one embodiment, the identification reading devices 94 are radio frequency identification device readers and the identification device 12 is a radio frequency identification device. In another embodiment, the identification reading devices 94 are optical scanners and the identification device 12 is an optical code such as a bar code or a QR code. In some embodiments, the identification reading devices 94 are radio frequency tuned circuit detectors and the identification device 12 is a radio frequency tuned circuits. There is no restriction as to the type of identification reading devices 94 and identification device 12.

At a registration desk of the miniature golf course, a player selects a golf club 10, typically to match the player's leg length or height and to provide a comfortable putting experience. In a preferred embodiment, there is an identification reading device 94 at the registration desk and the identification device 12 of the selected golf club 10 is read by the identification reading device 94 and an association is made between the value of the identification device 12 and a name of the player. Thereafter, when that same golf club 10 is recognized by any identification reading device 94, software determines that the current player is the player that selected that golf club 10.

The translation between the identification information and the golf player's name, as well as scoring, are stored in a user data area 502 that is accessible by the server computer 500. In this way, when computer instructions running on the server 500 receives identification information which is typically a set of symbols such as numerals, the computer instructions running on the server 500 translate those symbols into a name or identification of a golf player that is at the tee box.

In some embodiments, there are ball detectors 96, also operatively interfaced directly or indirectly to the computer instructions running on the server 500. The ball detectors 96 detect a location of the ball 18 (see FIGS. 4 and 5) as the ball 18 traverses the golf hole 19 or golf green (note that "golf hole" refers to the golf tee pad 16, fairway 20, green 24, obstacles 22 and cup 26 as shown in FIG. 5) and convey location and/or identification information to computer instructions running on the server 500. In some embodiments, the ball detectors 96 include electric eyes, detecting passing of the ball 18. In some embodiments, the ball detectors 96 determine motion and location of the ball 18, for example, using ultrasonic sound (Doppler Effect) or using cameras (e.g. video cameras such as charge-coupled device cameras) to detect markings of the ball 18 and exact location. In this way, the detected golf player is associated with a ball 18 that is at a certain location on the golf hole 19, so each time that specific ball 18 moves, the detected golf player is credited with one stroke. So, for example, when golf player-1 hits ball-1 and it travels to position-A on the golf green, ball movement data from the ball detectors 96 are analyzed to determine the position of the ball-1, position-A, and one stroke is recorded for player-1. Remembering the position-A, later, when that ball (ball-1) is hit again and ball-1 moves to position-B, ball movement data from the ball detectors 96 are analyzed and another stroke is recorded for player-1 and the position is updated, and so forth.

In some embodiments, the ball detectors 96 include cameras that recognize markings on the ball so that, when a player places their ball on the golf tee pad 16, a ball detector 96 (e.g. camera) at the golf tee pad 16 detects such markings (e.g. unique color or combination of colors) and the computer instructions running on the server 500 associates that ball with the player that will hit the ball by way of the identification device 12 of the selected golf club 10. Thereafter, each ball detector 96 will recognize start/stop movement of that specific ball to account for strokes counted against that player. Data from the ball detectors 96 are analyzed by the computer instructions running on the server 500.

Figure 2:
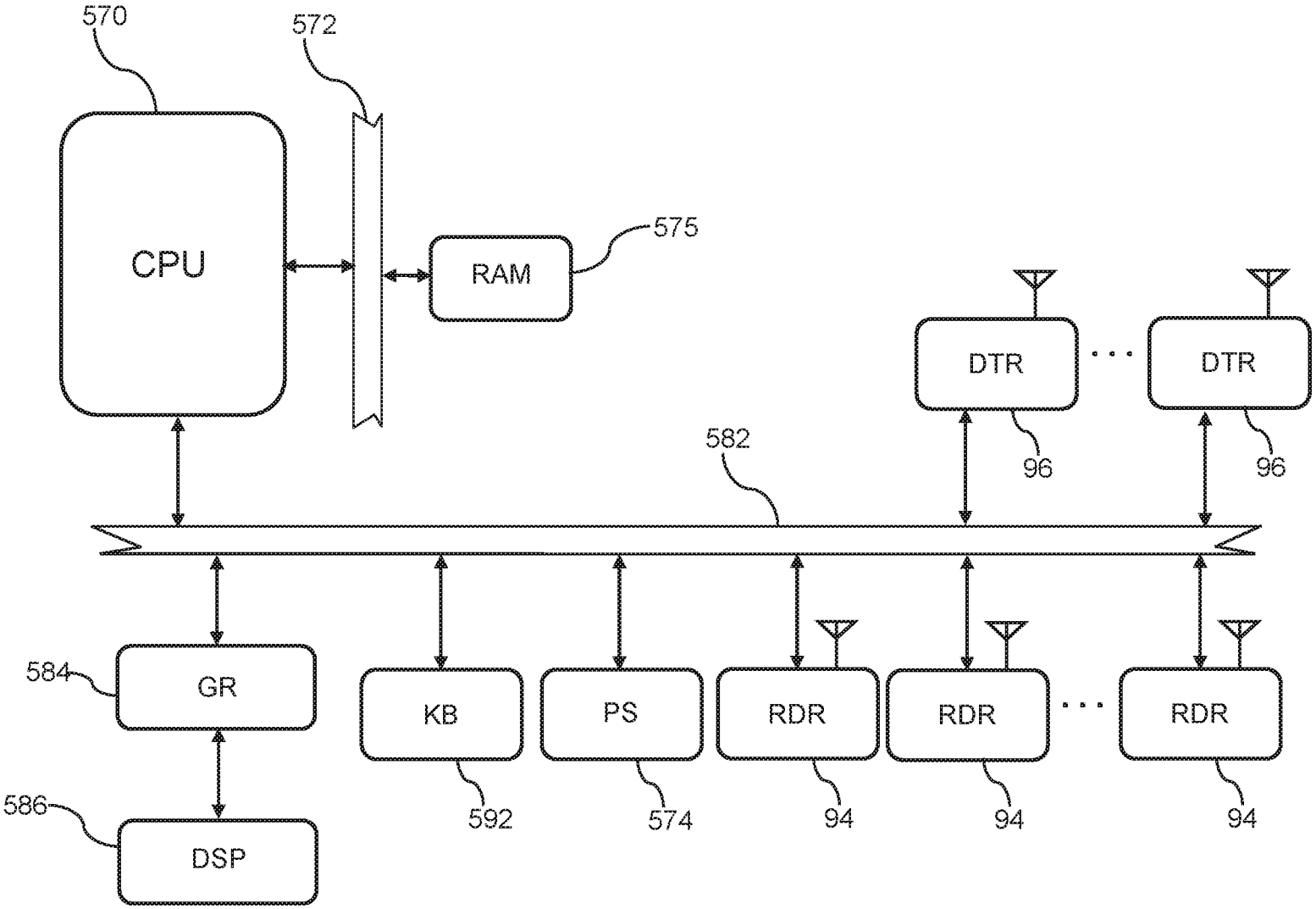
FIG. 2 illustrates a typical computer system of the system for managing miniature golf players.

Referring to FIG. 2, a schematic view of a typical computer system (e.g. server computer 500) is shown. The example computer system (e.g. server computer 500) represents a typical computer system used in the system for system for managing miniature golf players for calculating which golf player is present at the tee pad and, optionally, the location and/or trajectory of the ball 18. This exemplary computer system is shown in its simplest form. Different architectures are known that accomplish similar results in a similar fashion and the present invention is not limited in any way to any particular computer system architecture or implementation.

Although represented as a computer system 500 having a single processor 570, it is fully anticipated that other architectures be used to obtain the same or similar results, including multiple computers networked as known in the industry.

Figure 3:
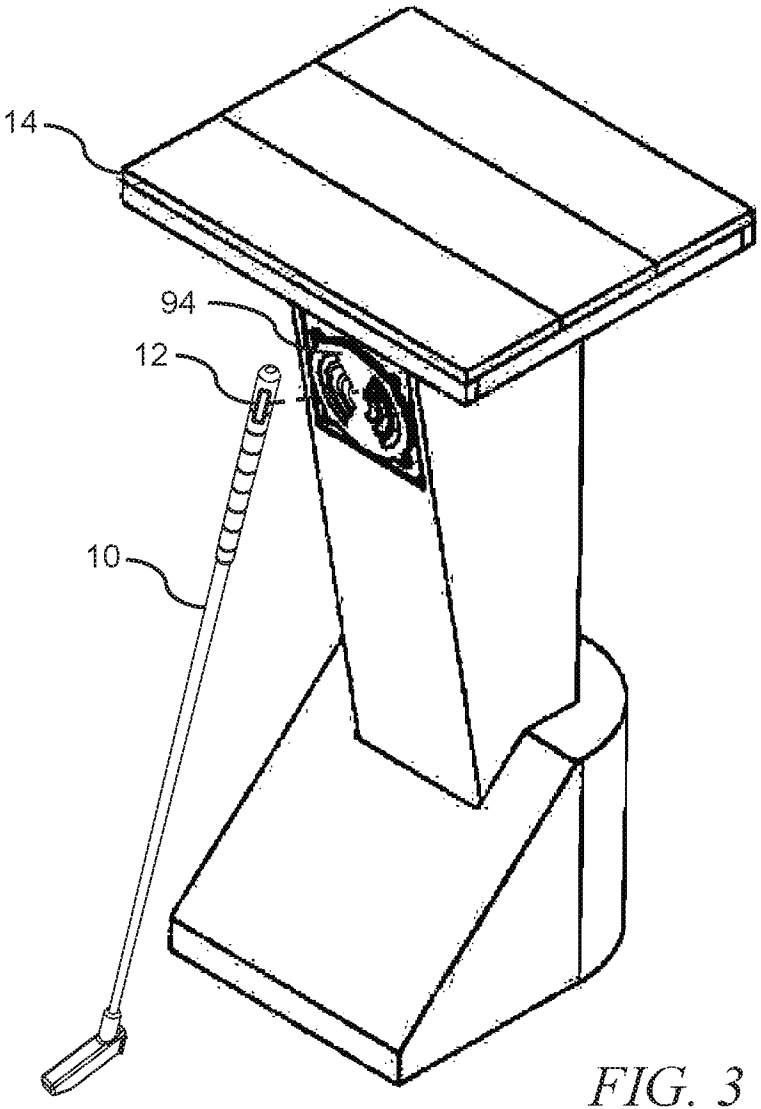
FIG. 3 illustrates a tee box pedestal of the system for managing miniature golf players.

In the example computer system 500 of FIG. 3, a processor 570 executes or runs programs in a random-access memory 575. The programs are generally stored within a persistent memory 574 and loaded into the random-access memory 575 when needed. The processor 570 is any processor, typically a processor designed for computer systems with any number of core processing elements, etc. The random-access memory 575 is connected to the processor by, for example, a memory bus 572. The random-access memory 575 is any memory suitable for connection and operation with the selected processor 570, such as SRAM, DRAM, SDRAM, RDRAM, DDR, DDR-2, etc. The persistent memory 574 is any type, configuration, capacity of memory suitable for persistently storing data, for example, magnetic storage, flash memory, read only memory, battery-backed memory, magnetic memory, etc. The persistent memory 574 (e.g., disk storage) is typically interfaced to the processor 570 through a system bus 582, or any other interface as known in the industry.

Also shown connected to the processor 570 through the system bus 582 is a network interface 580 (e.g., for connecting to a data network 506), a graphics adapter 584 and a keyboard interface 592 (e.g., Universal Serial Bus—USB). The graphics adapter 584 receives commands from the processor 570 and controls what is depicted on a display 586. The keyboard interface 592 provides navigation, data entry, and selection features.

In general, some portion of the persistent memory 574 is used to store programs, executable code, data, and other data, etc.

The peripherals are examples and other devices are known in the industry such as pointing devices, touch-screen interfaces, speakers, microphones, USB interfaces, identification reading devices 94, Wi-Fi transceivers, ball detectors 96, etc. Although three identification reading devices 94 and two ball detectors 96 are shown, there is no limitation as to the numbers of such.

Referring to FIG. 3, a tee box pedestal 14 of one embodiment of the system for managing miniature golf players is shown. Typically, each golf hole 19 at a miniature golf course will have a tee box pedestal 14. In the past, the tee box pedestal was used as a writing surface for writing scores. In the example shown in FIG. 3, the tee box pedestal 14 includes an identification reading devices 94 such that, when the identification device 12 of a golf club 10 is located within range of the identification reading device 94, the identification information related to the golf player at the tee box is read and transferred to the server 500. Note, in such embodiments, it is preferable to locate the identification device 12 towards or on/in the handle of the golf club 10 for improved reading.

Figure 4:
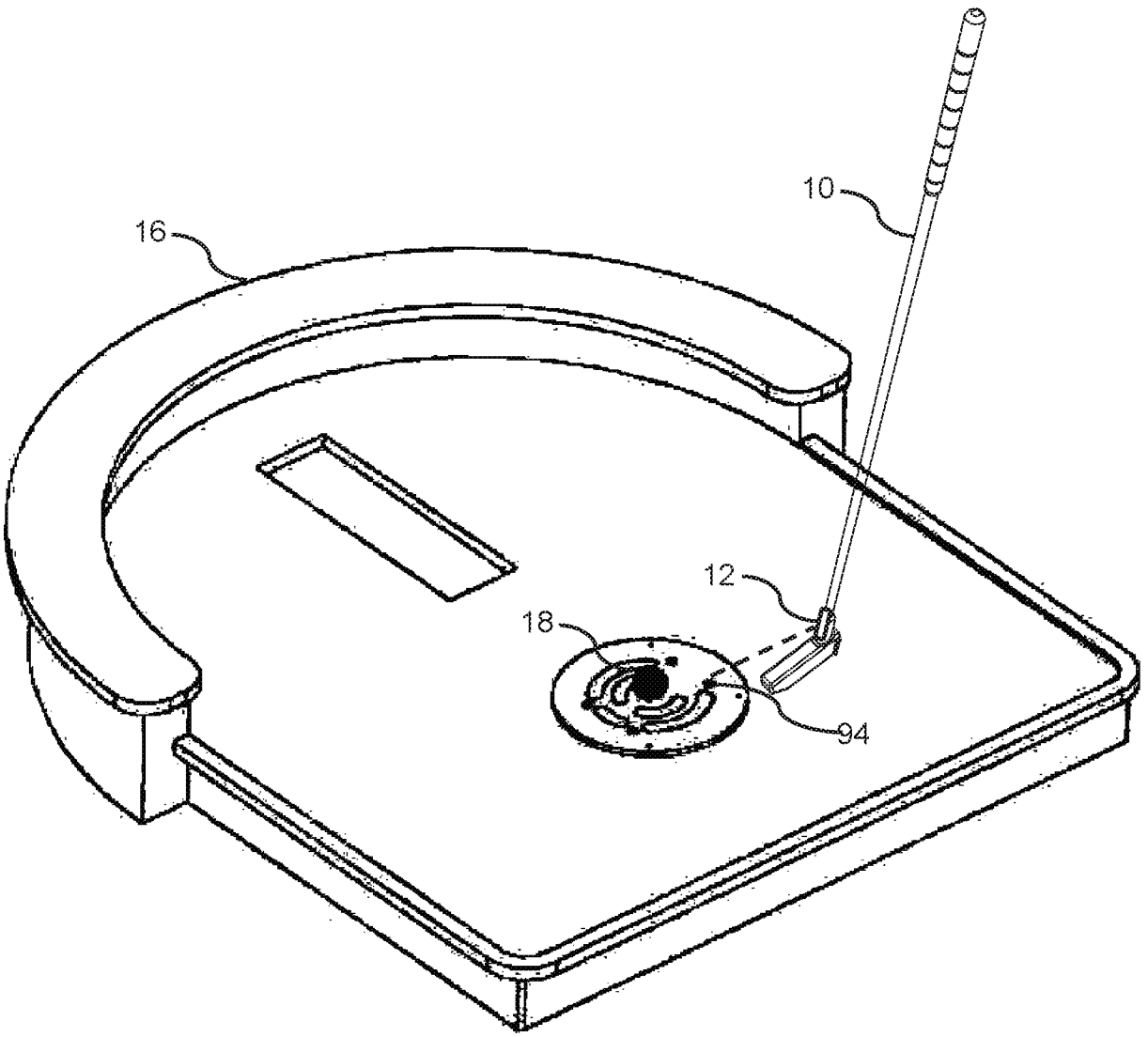
FIG. 4 illustrates a tee pad of the system for managing miniature golf players.
Figure 5:
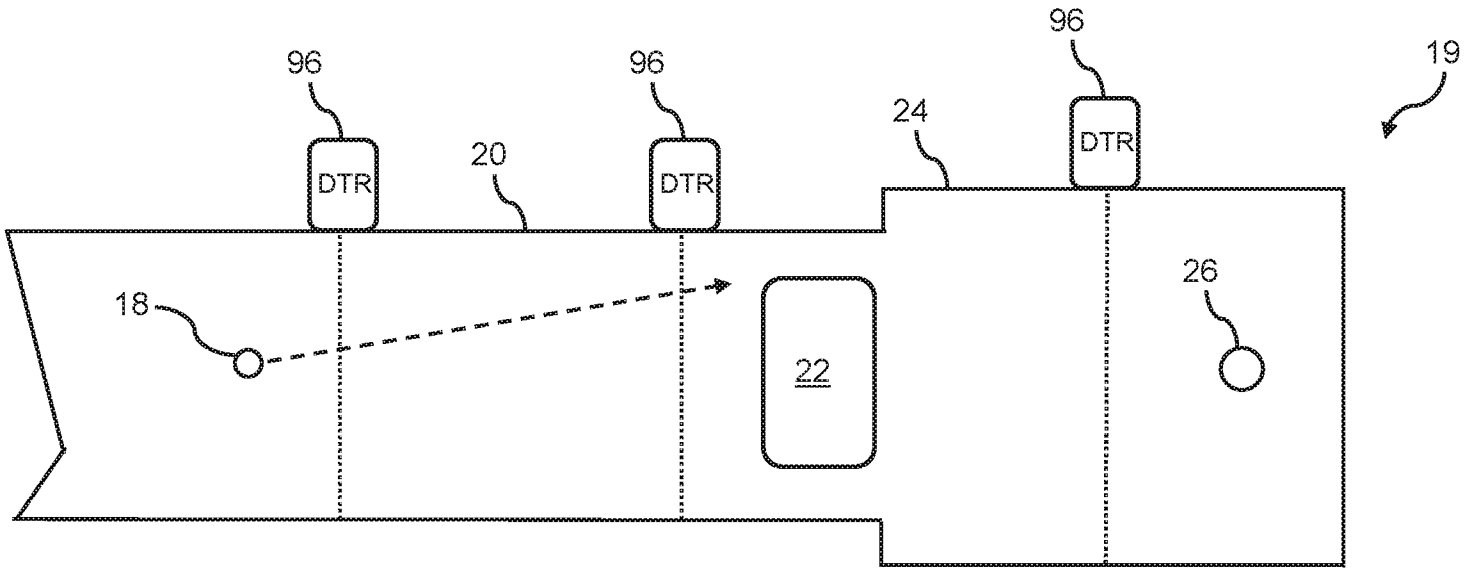
FIG. 5 illustrates an exemplary golf hole of the system for managing miniature golf players.

Referring to FIG. 4, a golf tee pad 16 of another embodiment of the system for managing miniature golf players is shown. Each golf hole 19 at a miniature golf course will have a golf tee pad 16. In the past, the tee pad was present only as a place to initiate play at each golf hole 19. In the example shown in FIG. 4, the golf tee pad 16 includes an identification reading device 94 such that, when the identification device 12 of a golf club 10 is located within range of the identification reading device 94, the identification information related to the golf player at the tee box is read and transferred to the server 500. Note, in such embodiments, it is preferable to locate the identification device 12 towards or on/in the head of the golf club 10 for improved reading.

FIG. 5 illustrates an exemplary golf hole 19 of the system for managing miniature golf players. The tee box is not shown for brevity reasons. The golf player has been identified at the tee box by an identification reading device 94 and the golf player has hit the ball 18 to the position shown. Now the golf player will hit the ball 18 in the direction shown. In some embodiments, movement of the ball 18 is detected by one or more ball detectors 96 as the ball 18 moves into and out of range of each ball detector 96. In the simplest example, the ball detectors 96 are electric eyes that are interrupted as the ball passes in front of each ball detector 96. In other embodiments, the ball detectors at motion detectors or cameras positioned around the fairway 20 and green 24 to detect the exact position of the ball 18 and the number of times the ball 18 initiates movement from rest (e.g. is hit by the golf player), translating into the number of strokes taken by that golf player until the ball 18 winds up in the cup 26. For completeness, an obstacle 22 is shown (e.g. a windmill, loop, etc.).

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A miniature golf system comprising:

a golf tee pad;

a pedestal at the golf tee pad;

an identification reading device integrated in or on the pedestal;

a golf club;

an identification device integrated in or integrated on the golf club and readable by the identification reading device; and a computer, when the identification device is detected by the identification reading device, the computer receives identification information from the identification reading device and the computer associates the identification information with a golf player who is assigned the golf club.

2. The miniature golf system of claim 1, wherein the identification reading device is a radio frequency identification device reader and the identification device is a radio frequency identification device.

3. The miniature golf system of claim 1, wherein the identification reading device is an optical scanner and the identification device is an optical code.

4. The miniature golf system of claim 3, wherein the optical code is a bar code.

5. The miniature golf system of claim 3, wherein the optical code is a QR code.

6. The miniature golf system of claim 1, wherein the computer scores the golf player who was at the golf tee pad for activities sensed at a fairway, a green, obstacles or a cup.

7. A method of automatically scoring a golf player, the method comprising:

detecting an identification device integrated on or integrated in a golf club and identifying the golf player at a golf tee pad by reading the identification device by an identification reading device in or on a pedestal located at the golf tee pad; and detecting activities at a fairway, a green, obstacles or a cup and crediting the golf player for the activities.

8. The method of automatically scoring the golf player of claim 7, wherein the identification reading device is a radio frequency identification device reader and the identification device is a radio frequency identification device.

9. The method of automatically scoring the golf player of claim 7, wherein the identification reading device is an optical scanner and the identification device is an optical code.

10. The method of automatically scoring the golf player of claim 9, wherein the optical code is a bar code.

11. The method of automatically scoring the golf player of claim 9, wherein the optical code is a QR code.

12. At least one program instruction tangibly embodied in a non-transitory storage medium for automatically scoring a golf player, wherein the at least one program instruction comprises:

responsive to the golf player moving a golf club within range of a pedestal that is located at a golf tee pad, computer readable instructions receive, a value of an identification device integrated with the golf club that is used by the golf player from an identification reading device integrated within the pedestal and the computer readable instructions associate activities thereafter with the golf player;

the computer readable instructions receive data from a plurality of sources regarding a golf ball that is hit by the golf club during play; and subsequently, each time the computer readable instructions receive the data, the computer readable instructions update a score of the golf player that was associated with the identification device of the golf club.

13. The at least one program instruction tangibly embodied in the non-transitory storage medium for automatically scoring the golf player of claim 12, wherein the identification reading device is a radio frequency identification device reader and the identification device is a radio frequency identification device.

14. The at least one program instruction tangibly embodied in the non-transitory storage medium for automatically scoring the golf player of claim 12, wherein the identification reading device is an optical scanner and the identification device is an optical code.

15. The at least one program instruction tangibly embodied in the non-transitory storage medium for automatically scoring the golf player of claim 14, wherein the optical code is a bar code.

16. The at least one program instruction tangibly embodied in the non-transitory storage medium for automatically scoring the golf player of claim 14, wherein the optical code is a QR code.

* * * * *